US006311037B1

(12) United States Patent
Hisakuni et al.

(10) Patent No.: US 6,311,037 B1
(45) Date of Patent: Oct. 30, 2001

(54) IMAGE-BEARING MEMBER CLEANING METHOD AND ELECTROPHOTOGRAPHIC IMAGE FORMING APPARATUS

(75) Inventors: Hisataka Hisakuni, Susono; Yuji Nakayama, Yokohama; Norihiko Kubo, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/453,507

(22) Filed: Dec. 3, 1999

(30) Foreign Application Priority Data

Dec. 4, 1998 (JP) ..... 10-346035
Apr. 28, 1999 (JP) ..... 11-122575

(51) Int. Cl.[7] ..... G03G 21/00; A47L 13/40

(52) U.S. Cl. ..... 399/350; 15/1.51; 399/346; 399/347; 399/351

(58) Field of Search ..... 15/1.51, 256.5, 15/123; 399/343, 346, 347, 350, 351; 430/56, 125

(56) References Cited

U.S. PATENT DOCUMENTS 3,552,850 * 1/1971 Royka et al. ..... 399/350
4,519,698 * 5/1985 Kohyama et al. ..... 399/350
5,124,222 * 6/1992 Clark et al. ..... 399/347
5,819,147 * 10/1998 Shoji ..... 399/284

FOREIGN PATENT DOCUMENTS 5-333585 * 12/1993 (JP) .

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

An electrophotographic image forming apparatus includes an image-bearing member for bearing a toner image thereon, a transfer device for transferring the toner image from the image-bearing member to a recording medium at a transfer position, a drive mechanism for moving the image-bearing member, and a cleaning blade abutted against the image-bearing member for removing a transfer residual toner remaining on the image-bearing member after the transfer of the toner image to the recording medium in accordance with the movement of the image-bearing member. The image forming apparatus is operated effectively for a long period by cleaning the image-bearing member according to a method wherein cleaning aid particles having a volume-average particle size of 0.1–3 $\mu$m smaller than that of the toner are caused to be resident in a width of 50–100 $\mu$m along an upstream side of the cleaning blade with respect to the moving direction of the image-bearing member.

16 Claims, 4 Drawing Sheets

IMAGE-BEARING MEMBER CLEANING METHOD AND ELECTROPHOTOGRAPHIC IMAGE FORMING APPARATUS

FIELD OF THE INVENTION AND RELATED ART

The present invention relates to a cleaning method for an image-bearing member used in an image forming apparatus according to electrophotography, inclusive of an electrostatic copying machine and an electrostatic printer, and an electrophotographic image forming apparatus adopting such a cleaning method.

In recent years, as image forming apparatus functioning as an output terminal working on a computer network, a complex machine having all functions of output terminals inclusive of a copying machine, a printer and a facsimile machine has been demanded on the market.

A demand on such an electrophotographic image forming apparatus is an increased duty cycle, i.e., an increase in upperlimit number of sheets on which the apparatus is normally operated without a maintenance service of a service engineer having a professional knowledge. A factor determining the duty cycle is a life of the image-bearing member.

Also from the ecological viewpoint, the image forming apparatus is seriously required to reduce the waste materials, i.e., to reduce the number of consumed articles and prolong the life of consumed articles.

Further, along with the progress of digital technology in recent years, digital-mode image forming apparatus is becoming predominant from hitherto predominant analog-mode image forming apparatus, and such digital mode apparatus is strongly desired to be produced at a cost comparable to or even lower than that of the analog-mode apparatus.

Further, copying machines and printers have been hitherto predominantly produced as monochromatic machines but are progressively converted into full-color machines in respects of both originals and output files. Accordingly, the production cost and running cost of a digital mode apparatus as described above and capable of full-color printing, are required to be suppressed at a level comparable to those of a monochromatic apparatus, thus remarkably reducing entire costs for users.

More specifically, the life of the image-bearing member for electrophotography depends on the performance of a cleaning device for removing a residual developer (or toner) remaining on the image-bearing member after a transfer step. In a well-known image forming apparatus, it is difficult to transfer the developer (or toner) constituting a visible image on an image-bearing member completely onto a transfer (receiving) material during the transfer step, and a slight portion of the toner inevitably remains on the image-bearing member after the transfer step. Further, some powdery fraction of the transfer material can remain on the image-bearing member due to contact thereof with the image-bearing member. Unless the portion of the toner and transfer material remaining on the image-bearing member after the transfer step (which may be inclusively referred to as "transfer residual toner" hereinafter in some cases) are sufficiently removed prior to a subsequent image forming cycle on the image-bearing member, the quality of an image formed in the subsequent image-forming cycle is lowered due to interference with the transfer residual toner. For this reason, the transfer residual toner has to be sufficiently removed after each transfer operation.

As cleaning means for the above purpose, various devices have been proposed heretofore. For example, there has been proposed a cleaning device including a cleaning blade comprising a resilient material, such as rubber, and abutted against the image-bearing member for removing by scraping off the transfer residual toner by an edge of the cleaning blade. The cleaning device is simple in structure, can be produced at a low cost and yet exhibits excellent performance of removing the transfer residual toner. Accordingly, such a cleaning device using a cleaning blade has been widely commercialized.

FIG. 1 is a schematic side sectional view of a conventional cleaning device disposed in proximity to a rotatory cylindrical image-bearing member 51 having an axis extending in a direction perpendicular to the drawing paper. Around the image-bearing member 51, a charger, a developing device and a transfer means are disposed though not shown in FIG. 1.

The cleaning device comprises a casing 53 having an opening directed toward the image-bearing member 51 and a cleaning blade 52 of urethane rubber, etc., affixed at one edge thereof with the edge of the opening, so that the other edge of the blade 52 is abutted against the image-bearing member so as to scrape off the transfer residual toner remaining on the image-bearing member after the transfer zone.

A portion of the transfer residual toner scraped off by the cleaning blade 52 and resident on the image-bearing member 51 functions to reduce the friction between the cleaning blade 52 and the image-bearing member 51, whereby a good cleaning performance can be attained without a turnover of the cleaning blade 52.

FIG. 2 illustrates another known cleaning device 43, which is disposed in proximity to a rotatable cylindrical image-bearing member 32 having a rotation axis extending in a direction perpendicular to the drawing paper. Similarly as in FIG. 1, a charger, a developing device, a transfer means, etc., are disposed around the cylindrical image-bearing member 32 though not shown in FIG. 2. The image-bearing member 32 is rotated in the direction of an indicated arrow A by a drive mechanism (not shown).

The cleaning device 43 comprises a casing 44 having an opening facing the image-bearing member 32. At the opening, a cleaning blade 45 of urethane rubber, etc., is affixed with its one end by means of a supporting member 46. The cleaning blade 45 is supplied with a force exerted from a spring (elastic member) 49 via a fulcrum 50 so as to be abutted with the other end thereof against the image-bearing member 32. The cleaning blade 45 is disposed in a counter direction with respect to the drive direction of the image-bearing member 32, i.e., in a direction such that the direction from the root (supported position) of the cleaning blade 45 toward a point of contact thereof with the image-bearing member is almost opposite to the direction of movement of the image-bearing member contacting the blade 45. The transfer residual toner occurring at a transfer position (not shown) on the image-bearing member is moved to the edge of the cleaning blade 45 to be scraped off thereby.

A portion of the transfer residual toner scraped off by the cleaning blade 45 is caused to remain on the image-bearing member 32 under the rotation of the image-bearing member 32. The transfer residual toner remaining in a small amount is supplied to the edge of the cleaning blade 45, whereby a good cleaning performance can be attained without turnover of the cleaning blade 45. Thus, the transfer residual toner powder reduces the frictional force acting between the blade 45 and the image-bearing member 32.

The presence of silica fine particles of ca. 0.01 μm in volume-average particle size (diameter) externally added to the developer for improving the flowability of the developer and stabilizing the abutment of the cleaning blade against the image-bearing member is effective for further reducing the abutting force acting at the abutting position.

However, as the amount of transfer residual toner varies depending on the image density of originals to be reproduced, it is difficult to always supply a constant amount of developer to the abutting position to stably retain the abutting state.

For example, in the case of forming a large number of images at a low image density, a smaller amount of developer is supplied to the abutting position. As a result, the effect of reducing the abutting force acting between the cleaning blade and the image-bearing member is liable to be insufficient, whereby the cleaning blade can be turned over toward the direction of movement of the image-bearing member, so that the function of scraping off the attached matter on the image-bearing member can be significantly lowered but an impacting force can be applied onto the image-bearing member, thus damaging the image-bearing member.

On the other hand, in the case of forming a large number of images at a high image density or supply of yet-untransferred developer to the cleaning device, a large amount of developer can be brought to the cleaning position by the cleaning blade, whereby the scraping of the developer by the cleaning blade becomes impossible. As a result, not only a substantial portion of the developer can pass by the cleaning blade to disturb subsequently-formed images, but also other problems can be caused, such that a portion of the developer is put or interposed between the blade tip and the image-bearing member to damage the image-bearing member or is caused to soil the charger disposed downstream of the cleaning blade.

Accordingly, in order to maintain the cleaning performance of removing attached matters on the image-bearing member, it is necessary to stably supply particles of developer, etc., to the abutting position or edge side of the cleaning blade. For this reason, it has been hitherto practiced to dispose a cleaning roller as an auxiliary cleaning means at a position upstream of the cleaning blade so as to supply a relatively constant amount of developer to the edge side of the cleaning blade without depending on the density of original image to be formed.

The disposition of such an auxiliary cleaning means requires a complicated structure and is not allowed because of shortage of space for providing such auxiliary cleaning means, e.g., in case of using a cylindrical image-bearing member of a small diameter.

Another approach for retaining the cleaning performance is to increase the pressing force exerted by the cleaning blade. This however results in increased deterioration, as by abrasion damage, of the image-bearing member, thus shortening the life of the image-bearing member.

As another trend, an attempt of using a smaller particle size toner has been made for realizing higher definition and higher quality images. As a method of achieving the attempt, it has been practiced to use toner particles directly produced through a polymerization process, which is known to be effective for providing spherical toner particles of a small particle size at a narrower particle size distribution. Such spherical toner particles are however also known to be difficult to remove by scraping-off from the surface of an image-bearing member. This is explained with reference to FIG. 2. When an image-bearing member 32 is driven, the tip of a cleaning blade 45 abutted against the image-bearing member 32 is liable to cause minute vibration, and if even a small gap is formed between the cleaning blade 45 tip and the image-bearing member 32 surface as a result of the minute vibration, such spherical toner particles are liable to slip through the gap more easily than non-spherical toner particles as produced through the conventional pulverization process.

The performance of the cleaning blade 45 for removing the transfer residual toner on the image-bearing member depends on the abutting pressure exerted by the cleaning blade 45 against the image-bearing member 32. In the case of using conventional non-spherical toner particles as produced through the pulverization process, an abutting pressure on the order of 25 g-f/cm has been used. Accordingly, it is conceived to apply an increased abutting pressure in order to scrape off the image-bearing member 32 a spherical toner of which the removal is more difficult than the conventional non-spherical toner. However, as the cleaning blade 32 is abutted against the image-bearing member 32 in a counter direction relative to the drive direction of the image-bearing member 32, the tip of the cleaning blade 32 can be turned over toward the drive direction if the abutting pressure is excessively increased to result in an increased frictional force, thus causing cleaning failure. Further, an increased abutting pressure of the cleaning blade 45 is liable to accelerate the wearing of the image-bearing member 32 due to friction, thus shortening the life of the image-bearing member 32.

SUMMARY OF THE INVENTION

An object of the present invention is to provide a cleaning method for an image-bearing member for electrophotography capable of stably realizing good performance of cleaning transfer residual toner for a long period.

Another object of the present invention is to provide a cleaning method for an image-bearing member for electrophotography capable of stably exhibiting good performance of cleaning transfer residual toner even in case of using a spherical toner.

A further object of the present invention is to provide an electrophotographic image forming apparatus adopting such a cleaning method (or system).

According to the present invention, there is provided a cleaning method for an image-bearing member in an electrophotographic image forming apparatus of the type including an image-bearing member for bearing a toner image thereon, a transfer means for transferring the toner image from the image-bearing member to a recording medium at a transfer position, a drive mechanism for moving the image-bearing member, and a cleaning blade abutted against the image-bearing member for removing a transfer residual toner remaining on the image-bearing member after the transfer of the toner image to the recording medium in accordance with the movement of the image-bearing member, wherein cleaning aid particles having a volume-average particle size of 0.1–3 μm smaller than that of the toner are caused to be resident in a width of 50–100 μm along an upstream side of the cleaning blade with respect to the moving direction of the image-bearing member.

According to another aspect of the present invention, there is provided an electrophotographic image forming apparatus, comprising: an image-bearing member for bearing a toner image thereon, a transfer means for transferring the toner image from the image-bearing member to a recording medium at a transfer position, a drive mechanism for moving the image-bearing member, and a cleaning blade abutted against the image-bearing member for removing a transfer residual toner remaining on the image-bearing member after the transfer of the toner image to the recording medium in accordance with the movement of the image-bearing member, wherein said image forming apparatus further includes a cleaning aid-supply means for supplying cleaning aid particles at a position downstream of the transfer means and upstream of the cleaning blade, respectively with respect to the moving direction of the image-bearing member.

In the cleaning method of the present invention, the cleaning aid particles are caused to be resident along the upstream side or edge of the cleaning blade to dam up the transfer residual toner, whereby even when the cleaning blade causes minute vibration at the abutting position along with the drive of the image-bearing member, the toner particles are prevented from slipping into the gap between the cleaning blade and the image-bearing member at the abutting position but can be effectively removed from the surface of the image-bearing member. For the same reason, spherical toner particles can be well removed at an abutting pressure comparable to that applied for cleaning of non-spherical toner particles. Further, as the effective cleaning is performed without increasing the abutting pressure, the life of the image-bearing member can be extended.

Further, in the electrophotographic image forming apparatus according to the present invention provided with a cleaning aid supply means at a position downstream of the transfer means and upstream of the cleaning blade, the amount and therefore the residential width of the cleaning aid particles resident along the upstream side of the cleaning blade can be directly and easily adjusted to exhibit optimum performances.

These and other objects, features and advantages of the present invention will become more apparent upon a consideration of the following description of the preferred embodiments of the present invention taken in conjunction with the accompanying drawings.

PREFERRED EMBODIMENTS OF THE INVENTION

Figure 3:
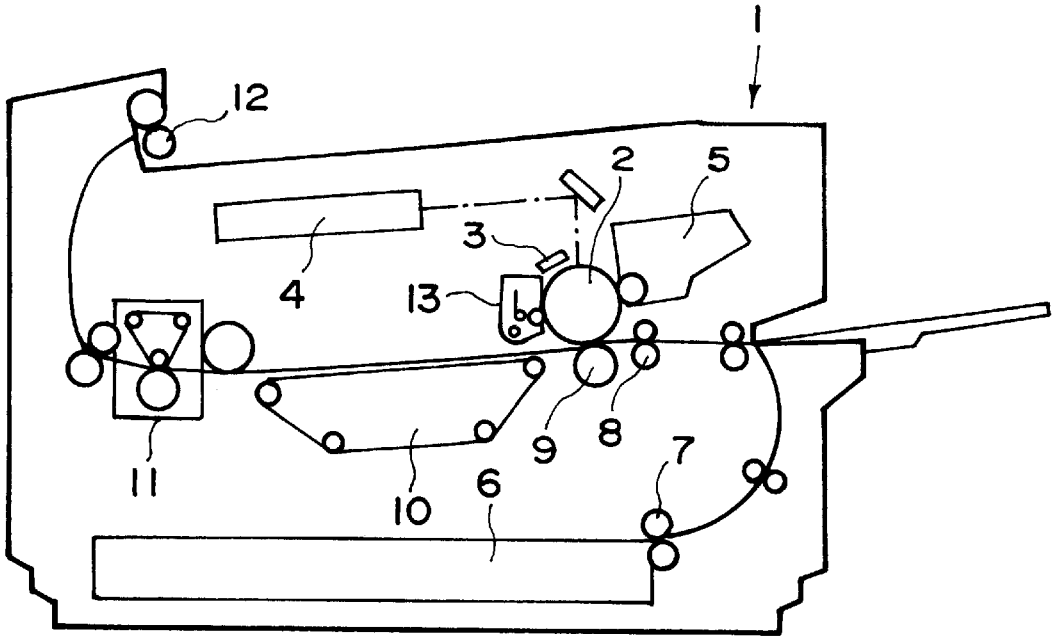
FIG. 3 is a schematic illustration of an electrophotographic image forming apparatus suitable for adopting a cleaning method according to the invention.
Figure 4:
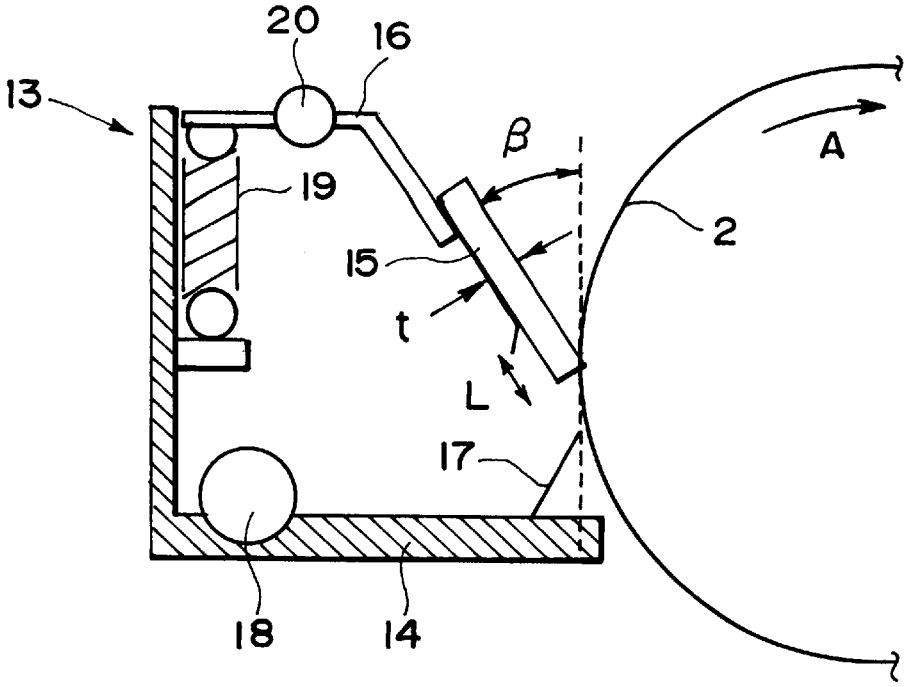
FIG. 4 is a side sectional view of a cleaning device according to the invention adopted in Example 4 described hereinafter.
Figure 5:
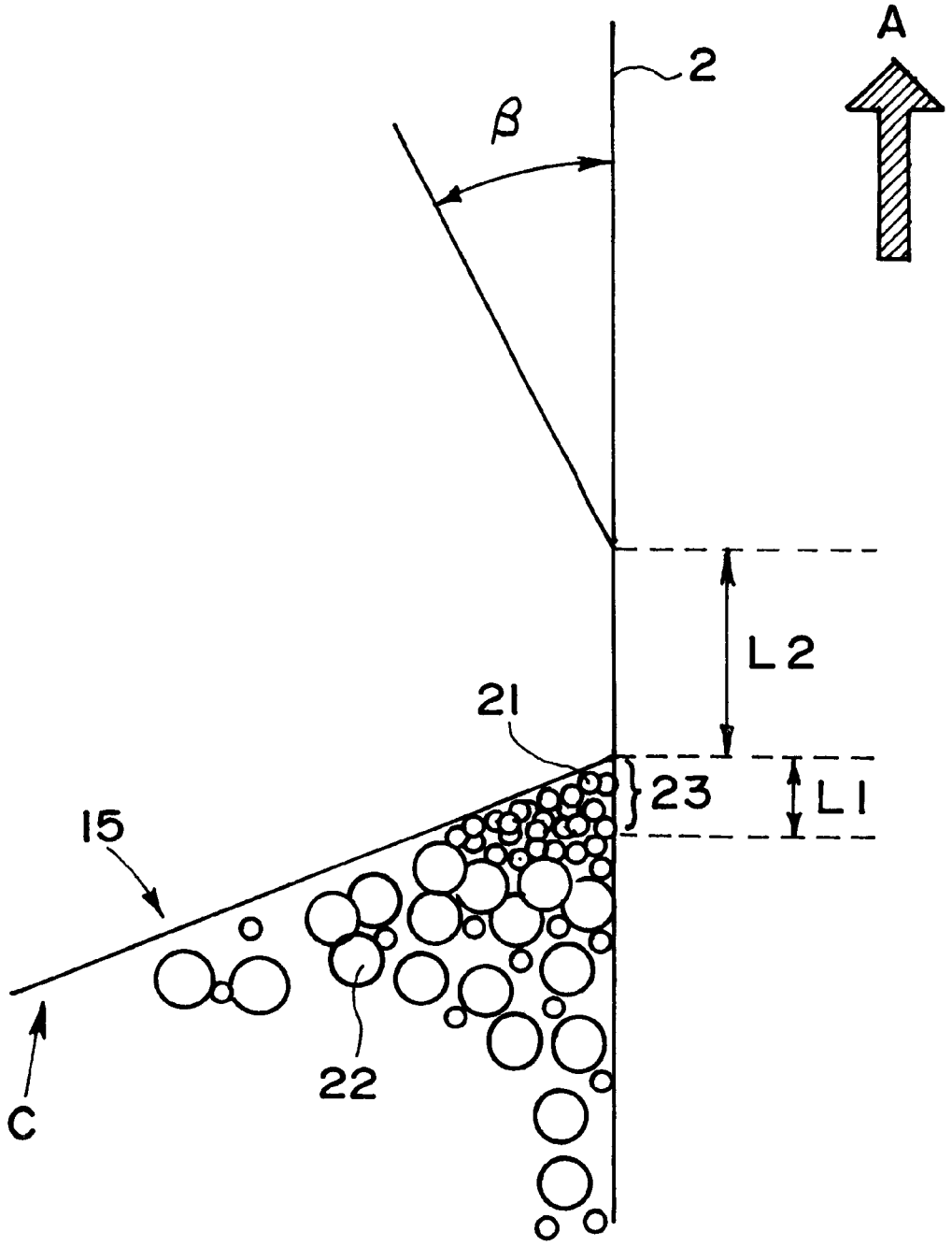
FIG. 5 illustrates a cleaning function according to the Leaning method of the invention.

FIG. 3 is a schematic sectional view of an electrophotographic image forming apparatus to which the cleaning method according to the present invention is suitably applied; FIG. 4 is a side sectional view of a cleaning device 13 used therein; and FIG. 5 is an illustration of a function of the cleaning device in the neighborhood of the abutting position of a cleaning blade 15 against an image-bearing member 2.

Figure 1:
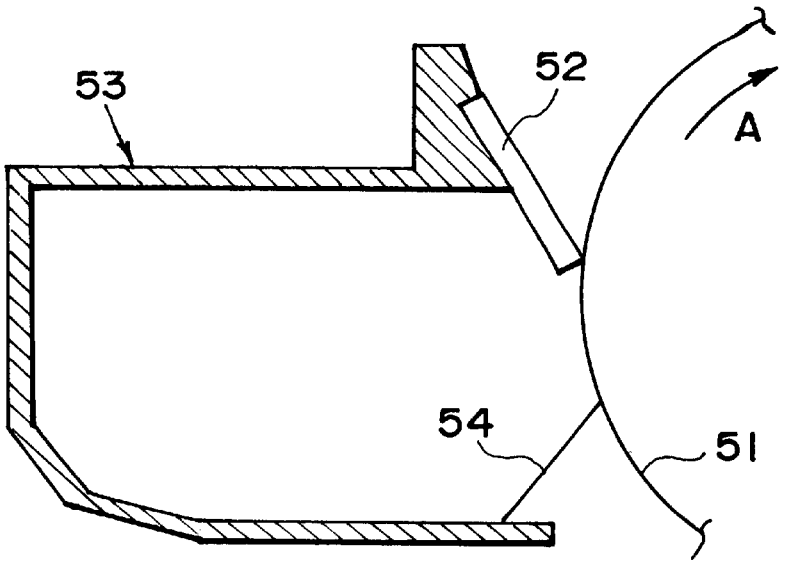
FIG. 1 is a side sectional view of a conventional cleaning device.

FIG. 3 shows an image forming apparatus 1 which is an electrophotographic copying machine, whereby a toner image is formed on a sheet of recording medium supplied from a cassette 6 based on image signals supplied from a signal source, such as a computer (not shown). Referring to FIG. 1, the image forming apparatus 1 includes at its lower part a cassette 6 for loading sheets of recording medium, such as plain paper. Beside the cassette 6 are disposed a pair of supply rollers 7 for supplying the recording sheets to a transfer means 9 and a pair of register rollers 8 for correcting oblique movement of the recording sheets. Ahead of the register rollers 8 and opposite the transfer means 9 is disposed an image-bearing member 2 on which an electrostatic image is formed as a charged pattern image and is developed to formed a toner image. Around the image-bearing member 2 are sequentially disposed a charger means 3 for uniformly charging the image-bearing member 2, an imagewise exposure means for exposing the charged image-bearing member to laser light carrying image data supplied from a laser oscillator 4 driven by an image source (not shown) such as a computer to form an electrostatic latent image on the image-bearing member 2, a developing device 5 for developing the electrostatic latent image by attaching a toner to the latent image to form a toner image on the image-bearing member 2, a transfer means 9 for transferring the toner image born on the image-bearing member 2 onto the recording sheet supplied thereto, and a cleaning blade 13 for removing transfer residual toner remaining on the image-bearing member 2 after the transfer. The toner (developer) supplied from the developing device 5 contains cleaning aid particles 21 (FIG. 5) having a smaller particle size than the toner particles. Ahead of the transfer means 9 is disposed a conveyer belt 10 for conveying the recording sheet carrying the transferred toner image thereon to a fixing means 11, wherein the sheet carrying the toner image is heated under pressure to melt-fix the toner image onto the recording sheet. Ahead of the fixing means 9 are disposed a pair of discharge rollers 12 for discharging the recording sheet carrying the fixed toner image thereon out of the image forming apparatus 1.

In a specific embodiment, the image-bearing member 2 may comprise an OPC (organic photoconductor) photosensitive member having coating layers of a charge generation layer using a titanylphthalocyanine and a charge transport layer comprising a bisphenol Z-type polycarbonate as a binder. Alternatively, it is also possible to use an A-Si (amorphous silicon) photosensitive member or an Se (selenium) photosensitive member. In this embodiment of image forming apparatus 1, the image-bearing member 2 is provided with a heater therein so as to maintain a surface temperature of 35–45° C. This is effective for preventing moisture absorption at the surface of the image-bearing member 2 in a high-humidity environment and also for suppressing the change in physical properties of the cleaning blade 15 due to a temperature change.

The recording sheets loaded on the cassette 6 are separately supplied sheet by sheet by the supply rollers 7 while being corrected with respect to their oblique movement by the pair of register rollers 8, to reach the image-bearing member 2 at a transfer position. At the transfer position, the toner image born on the image-bearing member is transferred onto the recording sheet. The transfer residual toner remaining on the surface of the image-bearing member 2 after the transfer of the toner image onto the recording sheet is removed by the cleaning device 13, and the image-bearing member 2 is thereafter subjected to a subsequent image forming cycle. The recording sheet having received the transferred toner image is sent by the conveyer belt to the fixing means 11, where the toner image is fixed onto the recording sheet under application of heat and pressure. The recording sheet carrying the fixed toner image is then discharged out of the image forming apparatus by means of the discharge rollers 12.

The formation of a toner image on the image-bearing member 2 may be performed in the following manner.

The image-bearing member 2 is uniformly charged by the charging means 3. The charged image-bearing member 2 is then locally exposed to a laser beam carrying image signals supplied from a laser oscillator 4 driven based on image signals supplied from an image source such as a computer to form an electrostatic latent image on the image-bearing member 2 corresponding to the laser beam exposure pattern. The electrostatic latent image as a charged pattern is developed by attachment of a toner (as a developer) to form a visible toner image on the image-bearing member 2.

Cleaning Device

As shown in FIG. 4, the cleaning device 13 comprises a casing 14 having an opening facing the image-bearing member 2. At the opening, a cleaning blade 15 comprising urethane rubber, etc., is affixed to one end of a support member 16. The support member 16 is supported via a fulcrum 20 and affixed to a spring (elastic member) 19 at the other end. The elastic power exerted by the spring 20 is transferred via the fulcrum 20 to the cleaning blade 15, whereby one edge of the cleaning blade 15 is abutted against the image-bearing member 2. Transfer residual toner remaining on the image-bearing member 2 without being completely transferred by the transfer means 9 is scraped off by the cleaning blade 15 when it reaches the cleaning blade 15. At a lower part of the casing 14, a scooping sheet 17 is disposed for causing the scraped toner fall into the casing 14 and preventing the toner recovered in the casing 14 from flowing back to the image-bearing member 2.

In the casing 14, a screw 18 is disposed for conveying the residual toner recovered in the casing in a direction perpendicular to the drawing sheet of FIG. 4 to discharge the toner out of the cleaning device 13, whereby tie casing 14 is prevented from being filled up with the recovered residual toner.

The setting conditions of the cleaning blade 15 with respect to the image-bearing member 2 are important factors determining the cleaning performances of the cleaning blade 15, including an abutting pressure, an abutting angle β, a free length L and a cleaning blade thickness t.

FIG. 5 illustrates a state of parts in proximity to the abutting position between the cleaning blade 15 and the image-bearing member 2 during a cleaning operation. Referring to FIG. 5, transfer residual toner 22 and cleaning aid particles 21 admixed in advance with the fresh toner, remaining on the surface of the image-bearing member 2, are brought along with the rotation of the image-bearing member 2 to the abutting position between the cleaning blade 15 and the image-bearing member 2. The transfer residual toner 22 and the cleaning aid 21 are scraped off by the cleaning blade 15 at the abutting position, but a portion thereof is caused to remain and be resident upstream of the cleaning blade 15 with respect to the drive direction A of the image-bearing member 2.

As shown in FIG. 15, a wedge-shaped space or gap is formed between the cleaning blade 15 and the image-bearing member 2, so that the gap is narrower at a position closer to the abutting position. As a result, the transfer residual toner 22 is not allowed to enter a region of a gap smaller than its particle size but the cleaning aid particles 21 having a smaller particle size intrude into the region of a smaller gap. The cleaning aid particles 21 having entered the narrow region in proximity to the abutting position between the cleaning blade 15 and the image-bearing member are resident therein and further push the transfer residual toner 22 away toward the upstream side, thus forming a cleaning aid residential layer 23.

In the absence of such a residential layer 23 of cleaning aid particles 21 as in a conventional cleaning blade system, when the cleaning blade 15 causes a minute vibration due to a frictional force acting between the cleaning blade 15 and the image-bearing member 2, the transfer residual toner 22 is allowed to slip by through the resultant gap between the cleaning blade 15 and the image-bearing member 2.

In contrast thereto, in the case where the residential layer 23 of cleaning aid particles 21 is formed, even a small gap is formed for a short period between the cleaning blade 15 and the image-bearing member 2 due to minute vibration of the cleaning blade 15, the cleaning aid particles 21 are allowed to be passed through the gap but the transfer residual toner 22 dammed up by the cleaning aid residential layer 23 cannot reach the gap in such a short period, whereby the amount of the toner transfer residual toner 22 slipping by toward the downstream side of the abutting position between the cleaning blade 15 and the image-bearing member 2 can be reduced.

Next, preferred conditions for improving the cleaning performance by such a cleaning aid residential layer 23 will now be described. A factor for determining a residential width L1 of the residential layer 23 relative to a cleaning blade abutting width L2 is a mixing proportion of the cleaning aid 21 with the transfer residual toner 22.

The effect of the present invention is accomplished by using cleaning aid particles having a volume-average particle size of 0.1–3 μm, i.e., an average diameter giving a particle volume equivalent to the volume of a spherical particle having a diameter of 0.1–3 μm. If the average particle size is below 0.1 μm, the cleaning aid particles are too small so that the cleaning a id particles frequently slip through between the cleaning blade and the image-bearing member, thus failing to provide a sufficient residential width of the cleaning aid particles. On the other hand, if the average particle size exceeds 3 μm, the transfer residual toner particles are allowed to commingle with the cleaning aid particles, thus being liable to slip through the gap between the cleaning blade and the image-bearing member together with the cleaning aid particles and cause a cleaning failure. It is preferred that the cleaning aid particles have a volume-average particle size of 1 μm or smaller.

So as to effectively isolate the transfer residual toner from the abutting edge portion of the cleaning blade, the residential width L1 of the cleaning aid particles may preferably be set to 50–100 μm.

The cleaning aid residential width L1 is stabilized at a certain value determined by a balance between the supply rate of the cleaning aid and the rate of slipping of the cleaning aid, depending on the mixing proportion of the cleaning aid with the transfer residual toner and the abutting condition of the cleaning blade against the image-bearing member. More specifically, so as to provide a cleaning aid residential width L1 of 50–100 μm, it is suitable that the cleaning aid is contained in a proportion of 5–40 wt. % with respect to the total of the transfer residual toner and the cleaning aid.

The cleaning aid may suitably comprise inorganic particles having a Mohs hardness of at least 6.0 as frequently used as abrasive particles. Examples of such inorganic particles may include particles of inorganic materials, such as strontium titanate, silicon oxide, aluminum oxide, titanium oxide, cerium oxide, germanium oxide, zinc oxide, tin oxide, zirconium oxide, molybdenum oxide, tungsten oxide, strontium oxide, boron oxide, silicon nitride, calcium titanate, magnesium titanate, phosphotungstic acid, phosphomolybdic acid, calcium carbonate, magnesium carbonate and aluminum carbonate.

The cleaning aid particles may suitably have a BET specific surface area of 1–10 $m^2/g$. More specifically, a larger BET specific surface area generally corresponds to a smaller particle size, so that cleaning aid particles of an excessively large BET specific surface are liable to show a smaller effect of damming up the transfer residual toner. On the other hand, cleaning aid particles of an excessively small BET are liable to be insufficiently separated from the transfer residual toner particles and exert a smaller frictional force especially when the toner particles are spherical in shape, whereby the toner particles are liable to slip through the cleaning blade together with the cleaning aid particles. For similar reason, the cleaning aid particles may more suitably have a volume-average particle size of 4–10 $\mu$m, particularly 5–10 $\mu$m when used together with indefinitely shaped toner particles and 4–8$\mu$ when used together with spherical toner particles.

The shape of toner particles may be defined by the following shape factors SF-1 and SF-2:

$$SF\text{-}1=(MXLNG)^2/AREA\times\pi/4\times100$$

$$SF\text{-}2=(PERIME)^2/AREA\times1/4\pi\times100$$

wherein MXLNG denotes a maximum length of a particle, PERIME denotes a perimeter of a particle projection image on a plane, and AREA denotes an area of the particle projection image on the plane. The shape factor SF-1 represents the roundness of a toner particle, and the shape factor SF-2 represents the surface unevenness of a toner particle. Both SF-1 and SF-2 become 100 when the projection image on a plane of a particle is a true sphere. A flat particle projection image provides a larger SF-1 value, and a complicated particle projection image provides a large SF-2 value.

An indefinitely shaped toner generally provides SF-1=150 to 200 and SF-2=130–150. A spherical toner showing $100\leqq SF\text{-}1\leqq140$ and $100\leqq SF\text{-}2\leqq120$, is suitably used.

An indefinitely shaped toner is generally produced through the so-called pulverization process wherein toner ingredients, such as a binder resin and a colorant, are melt-kneaded, pulverized and classified.

A representative of spherical toner is the so-called polymerization toner directly produced through a polymerization process wherein a polymerizable monomer composition comprising a polymerizable monomer, a colorant, etc., is dispersed in an aqueous dispersion medium predominantly comprising water to form liquid droplets wherein a non-polar substance is localized inside and a polar substance is localized at a superficial portion, and the polymerizable monomer in the liquid droplets is polymerized to form toner particles. As a result, the polar substance is localized at the surface of the resultant toner particles, and the toner particles exhibit a molecular orientation. Because of the surface polarity, the toner particles tend to show a lower attachability or agglomeratability with each other.

Accordingly, the polymerization toner tends to show a higher slippability between the particles thereof than the pulverization toner. As a result, the polymerization toner particles are liable to slip through or intrude into the abutting position of the cleaning blade because the polymerization toner particles resident along the cleaning blade edge exhibit only a weak force of damming up fresh transfer residual toner particle arriving thereat. Accordingly, it is more difficult to effect the cleaning of the polymerization toner than the pulverization toner.

The cleaning method according to the present invention is more effectively applied to a non-magnetic toner containing no magnetic material than a magnetic toner. More specifically, a magnetic toner containing a magnetic material has a generally lower charge than a non-magnetic toner so that it exhibits a smaller attachment force onto the photosensitive member as an image-bearing member. In contrast thereto, a non-magnetic toner has a generally higher triboelectric charge and exhibits a larger attachment force onto the photosensitive member. However, even such a non-magnetic toner can be effectively removed and cleaned by the cleaning method according to the present invention.

The cleaning blade may suitably be abutted against the image-bearing member at an abutting pressure of at least 10 g-f/cm so as to effectively scrape off the attached residue on the image-bearing member. However, an abutting pressure in excess of 30 g-f/cm is liable to promote the abrasion wearing of the image-bearing member. It is desirable to adopt a minimum abutting pressure within an extent of exhibiting a necessary cleaning performance.

Hereinbelow, the present invention will be described more specifically based on Examples.

EXAMPLE 1

| | |
|---|---|
| Styrene-n-butyl acrylate copolymer (Mp (peak-molecular weight) = 20,100) | 100 wt. parts |
| Styrene-methyl methacrylate-methacrylic acid copolymer (Mp = 21,000) | 100 wt. parts |
| Di-tert-butylsalicylic acid metal compound | 4 wt. parts |
| Paraffin wax (mp (melting point) = 83° C.) | 8 wt. parts |
| Carbon black (hydrophobized) | 12 wt. parts |

The above ingredients were preliminarily blended and melt-kneaded on a roll mill heated at 120° C. After being cooled, the melt-kneaded product was coarsely crushed and then finely pulverized by a pulverizer using a jet air stream, followed by classification to obtain toner particles having a volume-average particle size (Dv) of ca. 8 $\mu$m. The toner particles in 100 wt. parts were blended with 0.8 wt. part of hydrophobic silica (Dv=ca. 10 nm) to obtain a pulverization toner, which exhibited SF-1=160 and SF-2=135.

The toner was blended with various proportions (as will be described later) of pulverized and classified strontium titanate particles (Dv=0.5 $\mu$m, $S_{BET}$ (BET specific surface area)=4 $m^2/g$) as a cleaning aid. Each toner-cleaning aid mixture was blended with magnetic ferrite carrier particles (Dv=30 $\mu$m) to provide a two-component developer containing 6 wt. % of the toner based on the carrier particles.

The developer was incorporated in a commercially available copying machine ("NP4050", mfd. by Canon K.K.) after remodeling the developing device so as to be adapted to a two-component developer and the cleaning device as shown in FIG. 1, thereby evaluating the cleaning performance.

As a result of actual measurement, the cleaning blade 52 was abutted against the image-bearing member 51 at a pressure of 20 g-f/cm and an abutting width L2 (FIG. 5) of 80 μm.

Figure 6:
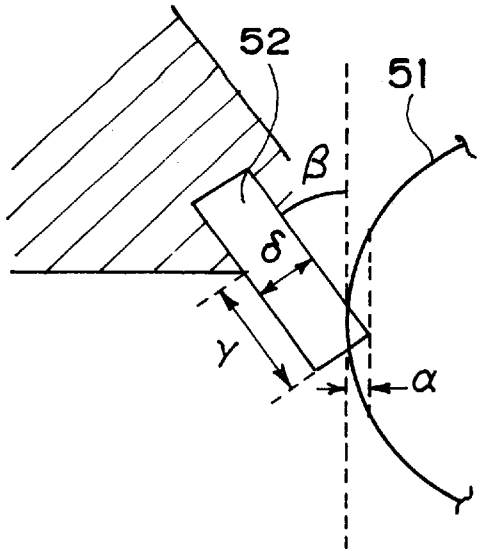
FIG. 6 illustrates a cleaning blade abutting condition.

With reference to FIG. 6, the cleaning blade 52 was abutted under the conditions of providing an assumed penetration (i.e., a penetration on an assumption of no image-bearing member 51 ) α of 1.5 mm, an inclination angle β from a tangential surface of the image-bearing member 51 of 30 deg., a free length γ of the cleaning blade 52 of 2 mm, and a cleaning blade thickness δ of 1.2 mm.

Figure 2:
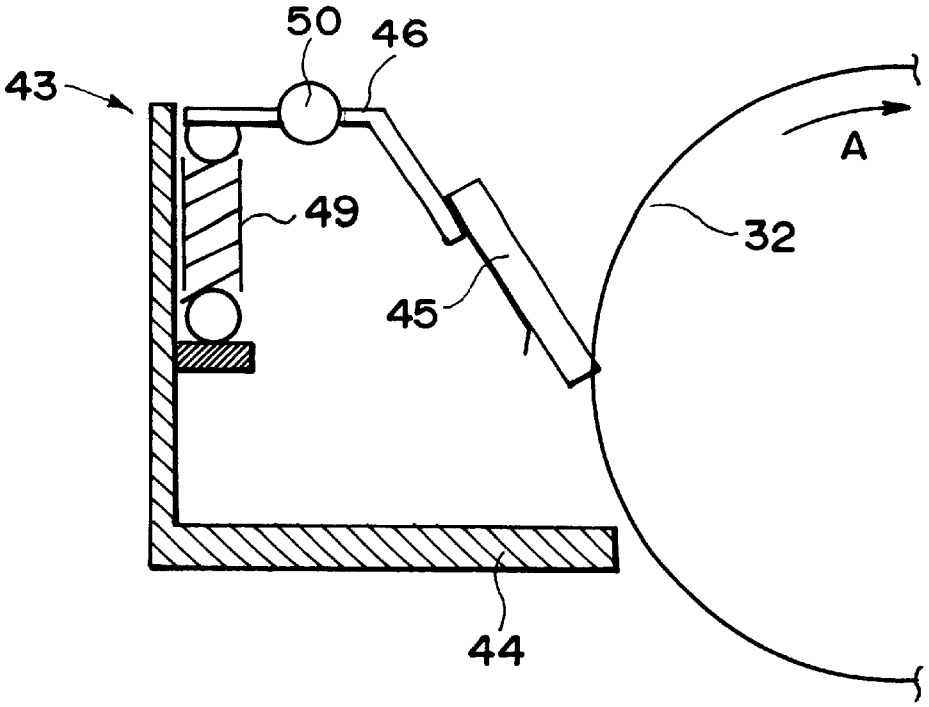
FIG. 2 is side sectional view of another conventional cleaning device.

The mixing proportions of the cleaning aid were changed in the range of 0.2–5.0 wt. % of the toner so as to provide various residential widths L1 of the cleaning aid residential layer 23 (FIG. 2) as shown in Table 1, whereby the cleaning performances as also shown in Table 1 were obtained.

TABLE 1

| Cleaning performances | | | | | | |
|---|---|---|---|---|---|---|
| Mixing proportion (wt. %) | 0.2 | 0.5 | 1.0 | 3.0 | 4.0 | 5.0 |
| L1 (μm) | 45 | 50 | 70 | 90 | 100 | 110 |
| Evaluation | SB | A | A | A | A | TO |

The cleaning performances were evaluated based on image qualities after continuous image formation on 20,000 sheets in an environment of 24° C. and 60% RH (relative humidity) according to the following standard.

A: No image soiling attributable to cleaning failure.

SB: Occurrence of poor images due to slipping-by of the toner between the cleaning blade and the image-bearing member.

TO: Occurrence of poor images due to cleaning failure caused by turnover of the cleaning blade.

As shown in Table 1, a shorter residential width L1 resulted in an insufficient cleaning of the transfer residual toner from the image-bearing member surface, thereby causing slipping-by of the toner. On the other hand, an excessively large residential width L1 resulted in an unclear boundary between the layer of the cleaning aid alone and the outside toner-rich layer, thus causing the interposition of the toner between the cleaning blade and the image-bearing member leading to turnover of the cleaning blade. As a result, good results were obtained in the residential width L1 range of 50–100 μm.

Incidentally, the shape factors SF-1 and SF-2 of the toner were measured by taking pictures at a magnification of 100 of sample toner particles through an electric field radiation-type scanning electron microscope ("S-800" (trade name), mfd. by Hitachi Seisakusho K.K.), selecting at random 100 toner particle images having a particle size (maximum length) of 2 μm or larger and supplying image data thereof via an interface to an image analyzer (e.g., "Luzex III" (trade name) 99999, mfd. by Nireco K.K.) for analysis of the image data.

Further, the volume-average particle sizes of the toner and the cleaning aid were obtained by calculation based on average volumes of the particles assumed to be spherical particles. More specifically, at least 300 sample particle images having a maximum diameter of 2 μm or larger (for a toner) or 0.02 μm or larger (for a cleaning aid) photographed through the scanning electron microscope ("S-800", mfd. by Hitachi Seisakusho K.K.) were selected to measure horizontal FERE diameters, from which volumes of respective particles assumed to be spherical particles were calculated to obtain a volume-basis particle size distribution and a volume-average particle size.

The cleaning aid residential widths L1 were measured in the following manner. A semitransparent image-bearing member having the same photosensitive layer as that of the commercial image forming apparatus ("NP4050", mfd. by Canon K.K.) and a drum substrate of glass instead of aluminum was prepared and used for the continuous image forming test, during which the proximity of the cleaning blade edge was observed from inside the semitransparent image-bearing member through a microscope to measure an actual width of the resident cleaning aid particles during the continuous image formation on paper sheets. The residential width L1 of a cleaning aid could be stabilized after passing only several sheets, but the residential width was measured after passing 100 sheets by using an original having an image density proportion of ca. 15% equal to that of an ordinarily used original in consideration of the fact that the mixing proportion of a cleaning aid within a transfer residual toner can change depending on the image density proportion.

EXAMPLE 2

Example 1 was repeated by using cerium oxide particles (Dv=0.8 μm, $S_{BET}$=2 $m^2/g$) instead of the strontium titanate particles, whereby similar results were obtained.

EXAMPLE 3

Example 1 was repeated by changing the abutting pressure of the cleaning blade onto the image-bearing member and the abutting width in the still state as shown in Table 2 which shows the results of changing the cleaning blade thickness in the range of 0.8–2.0 mm so as to vary the abutting pressure while keeping an abutting width L2=80 μm, a residential width L1=70 μm, α=1.0 mm, β=30 deg. and γ=2 mm, and in Table 3 which shows the results of changing the cleaning blade free length γ so as to change the abutting width while maintaining an abutting pressure=20 g-f/cm, L1=70 μm, α=1.0 mm, β=30 deg. and δ=2 mm. The results are also shown in Tables 2 and 3 similarly as in Table 1.

TABLE 2

| | | | | | |
|---|---|---|---|---|---|
| Cleaning blade thickness δ (mm) | 0.8 | 1.0 | 1.2 | 1.6 | 2.0 |
| Abutting pressure (g/cm) | 7 | 10 | 20 | 30 | 35 |
| Evaluation | SB | A | A | A | MA* |

*MA represents the occurrence of inferior images due to much abrasion of the image-bearing member surface caused by an excessive abutting force exerted by the cleaning blade against the image-bearing member.

TABLE 3

| | | | | | |
|---|---|---|---|---|---|
| Cleaning blade free length γ (mm) | 1 | 1.5 | 2 | 3 | 4 |
| Abutting width (μm) | 45 | 50 | 80 | 100 | 110 |
| Evaluation | MA | A | A | A | TO |

EXAMPLE 4

Into 710 g of deionized water, 450 g of 0.1 M—$Na_3PO_4$ aqueous solution was added, and the mixture was heated to 60° C. and stirred at 1200 rpm by a TK homomixer (mfd. by Tokushu Kika Kogyo K.K.). To the mixture under stirring, 68 g of 1.0 M—$CaCl_2$ aqueous solution was gradually added to obtain an aqueous dispersion medium containing $Ca_3(PO_4)_2$.

| | |
|---|---|
| Styrene | 165 wt. part(s) |
| n-Butyl acrylate | 35 wt. part(s) |
| Phthalocyanine pigment | 10 wt. part(s) |
| Di-t-butylsalicylic acid metal compound | 1 wt. part(s) |
| Styrene-methacrylic acid copolymer (mol ratio = 95:5, Mw = $5 \times 10^4$) | 10 wt. part(s) |
| Paraffin wax (mp = 83° C.) | 8 wt. part(s) |

The above ingredients were warmed at 60° C. and mutually dissolved and dispersed under stirring at 12000 rpm by a TK homomixer (mfd. by Tokushu Kika Kogyo K.K.), and 8 g of 2,2'-azobis(2,4-dimethylvaleronitrile) (as polymerization initiator) was dissolved therein to form a polymerizable monomer composition. The monomer composition was then charged into the above-prepared aqueous dispersion medium and stirred for 20 min. at 10000 rpm by a TK homomixer in a nitrogen gas atmosphere at 60° C. to form droplets of the monomer composition. Then, the system was stirred by a paddle stirrer and heated to 70° C. for 10 hours of polymerization.

After the polymerization, a portion of the aqueous medium was distilled off under vacuum, and the remainder was cooled, followed by addition of hydrochloric acid to dissolve the calcium phosphate, filtering, masking with water and drying to recover toner particles having a volume-average particle size (Dv) of ca. 8 $\mu$m.

To 100 wt. parts of the toner particles, 0.8 wt. part of hydrophobic silica (Dv=ca. 10 nm) was externally added to obtain a polymerization toner, which exhibited SF-1=120 and SF-2=110.

The toner was blended with various proportions (as will be described later) of pulverized and classified strontium titanate particles (Dv=0.5 $\mu$m, $S_{BET}$ (BET specific surface area)=4 $m^2/g$) as a cleaning aid. Each toner-cleaning aid mixture was blended with magnetic ferrite carrier particles (Dv=30 $\mu$m) to provide a two-component developer containing 6 wt. % of the toner based on the carrier particles.

The developer was incorporated in a commercially available copying machine ("NP4050", mfd. by Canon K.K.) after remodeling the developing device so as to be adapted to a two-component developer and the cleaning device as shown in FIG. 4, thereby evaluating the cleaning performance.

The cleaning device included a pressing mechanism using a spring 19 for stabilizing the abutting pressure of a cleaning blade 15 against an image-bearing member 2. For the purpose of comparison with a conventional case, the cleaning blade 15 was abutted at a pressure of 25 g-f/cm against the image-bearing member 2 similarly as in the conventional case. The cleaning blade 15 had a thickness t of 3 mm and a free length L of 5 mm, and the abutting angle β was variably adjustable.

The cleaning blade 15 was made of polyurethane rubber showing a JIS-A hardness of 73 deg. and a repulsion elasticity of 50% according to the JIS testing method for vulcanized rubber.

The mixing proportion of the cleaning aid was changed in the range of 0.5–10 wt. % of the toner, so as to provide various mixing proportions of the cleaning aid 21 in the transfer residual toner 22 as shown in Table 4 below. The mixing proportions shown in Table were measured by fluorescent X-ray analysis of waste toner stored in the casing 14 of the cleaning device 13 after a continuous image formation on 1000 sheets for reproduction of an original having an ordinary image density proportion of ca 15%. More specifically, 5 g of waste toner was subjected to fluorescent X-ray analysis and the content of cleaning aid therein was determined based on a calibration curve obtained by using toner composition containing known proportions of the cleaning aid.

TABLE 4

| Mixing proportion of cleaning aid (wt. %) | |
|---|---|
| in Fresh toner | in Transfer residual toner |
| 0.5 | 2 |
| 2 | 5 |
| 8 | 40 |
| 10 | 63 |

In this way, the mixing proportion of cleaning aid in the transfer residual toner (with respect to the total of the cleaning aid and the transfer residual toner) could be arbitrarily adjusted by changing the mixing proportion of the cleaning aid in the fresh toner (with respect to the fresh toner).

Incidentally, the cleaning aid 21 can also adhere to a non-image portion (i.e., white background). Accordingly, the mixing proportion of the cleaning aid can vary depending on the image density proportion of an image to be formed. Accordingly, in a different type of image forming apparatus ordinarily using a different level of image density proportion, the correlation shown in Table 4 may not be applied directly. In such a case, the mixing proportion of cleaning aid 21 in a fresh toner may be re-adjusted so as to provide a desired mixing proportion of cleaning aid in the transfer residual toner 22.

Next, the residential width L1 of cleaning aid 21 was controlled by changing the abutting angle β. The residential width 11 of cleaning aid 21 is affected by the mixing proportion of cleaning aid 21 in a fresh toner. Accordingly, the abutting angles β for providing various cleaning aid residential width L1 after continuous image formation on 100 sheets were examined at various cleaning aid mixing proportion levels in fresh toner, whereby the results shown in Table 5 were obtained.

TABLE 5

| Abutting angle β (deg.) for providing various residential width L1 of cleaning aid | | | | | |
|---|---|---|---|---|---|
| Mixing proportion | Residential width L1 | | | | |
| of cleaning aid in fresh toner | 25 $\mu$m | 50 $\mu$m | 75 $\mu$m | 100 $\mu$m | 125 $\mu$m (deg.) |
| 0.5 wt. % | 28 | 25 | 20 | — | — |
| 2 wt. % | 35 | 31 | 27 | 23 | 20 |
| 8 wt. % | 40 | 38 | 35 | 32 | 29 |
| 10 wt. % | — | 40 | 38 | 35 | 32 |

Referring to Table 5, at a cleaning aid mixing proportion of 0.5 wt. % in fresh toner, it was impossible to set a cleaning blade abutting angle β providing a cleaning aid residential width of 100 $\mu$m or larger. Further, at a cleaning aid mixing proportion of 10% in fresh toner, a large abutting angle β of the cleaning blade 15 for providing a cleaning aid residential width of 25 $\mu$m resulted in inferior cleaning performance so that the cleaning aid could not be satisfactorily resident.

In this way, it was possible to attain an arbitrary cleaning aid residential width L1 by changing the abutting angle β of the cleaning blade 15. The residential width L1 is determined depending on an abutting state between the cleaning blade 15 and the image-bearing member 2, and other setting conditions may also be changed so as to provide a desired cleaning aid residential width L1.

Continuous image forming tests were performed on 20,000 sheets in each environment of normal temperature/low humidity (NT/LH=24° C./10% RH), normal temperature/normal humidity (NT/NH=24° C./55% RH), and high temperature/high humidity (HT/HH=30° C./80% RH) while changing the mixing proportion of cleaning aid 21 in fresh toner and cleaning aid residential width L1. The results are inclusively shown in Table 6 below.

TABLE 6

| Cleaning aid in | | L1 (μm) | | | | |
|---|---|---|---|---|---|---|
| fresh toner | Environment | 25 | 50 | 75 | 100 | 125 |
| 0.5 wt. % | NT/LH | CF | CF | CF | — | — |
| | NT/NH | CF | A | A | — | — |
| | HT/HH | A | A | AS | — | — |
| 2 wt. % | NT/LH | CF | A | A | A | A |
| | NT/NH | CF | A | A | A | A |
| | HT/HH | A | A | A | A | AS |
| 8 wt. % | NT/LH | CF | A | A | A | A |
| | NT/NH | A | A | A | A | AS |
| | HT/HH | A | A | A | A | AS |
| 10 wt. % | NT/LH | — | A | A | A | AS |
| | NT/NH | — | A | A | AS | AS |
| | HT/HH | — | AS | AS | TO | TO |

In Table 6, "A" represents that the image formation on 20,000 sheets was completed without causing cleaning failure; "CF", the occurrence of image soiling due to cleaning failure before completing the image formation on 20,000 sheets; "AS", the occurrence of abnormal sound due to abnormal vibration of the cleaning blade; "TO", the occurrence of poor images due to cleaning failure caused by turnover of the cleaning blade similarly as in Table 1; and "–", that no test was performed because a corresponding residential width could not be obtained.

Referring to FIG. 6, in the environment of normal temperature/low humidity (NT/LH), cleaning failure occurred at any mixing proportion if the residential width was narrow (L1=25 μm). On the other hand, in the environment of high temperature/high humidity (HT/HH), the cleaning blade 15 caused abnormal sound in the case of a broad residential width (L1=125 μm).

The results shown in Table 6 exhibit that good cleaning performances for a spherical toner were attained in the case where the mixing proportion of cleaning aid 21 in fresh toner was in the range of 2–8 wt. % and the residential width L1 was in the range of 50–100 μm. In other words, from the results shown in Tables 4 and 6 in combination, good cleaning performances for a spherical toner could be attained in the case where the mixing proportion of cleaning aid in the transfer residual toner was in the range of 5–40 wt. %, and the residential width was 50–100 μm.

EXAMPLE 5

Example 4 was repeated by using cerium oxide particles (Dv=0.8 μm, $S_{BET}$=2 $m^2/g$) instead of the strontium titanate particles, whereby similar results were obtained.

EXAMPLE 6

Figure 7:
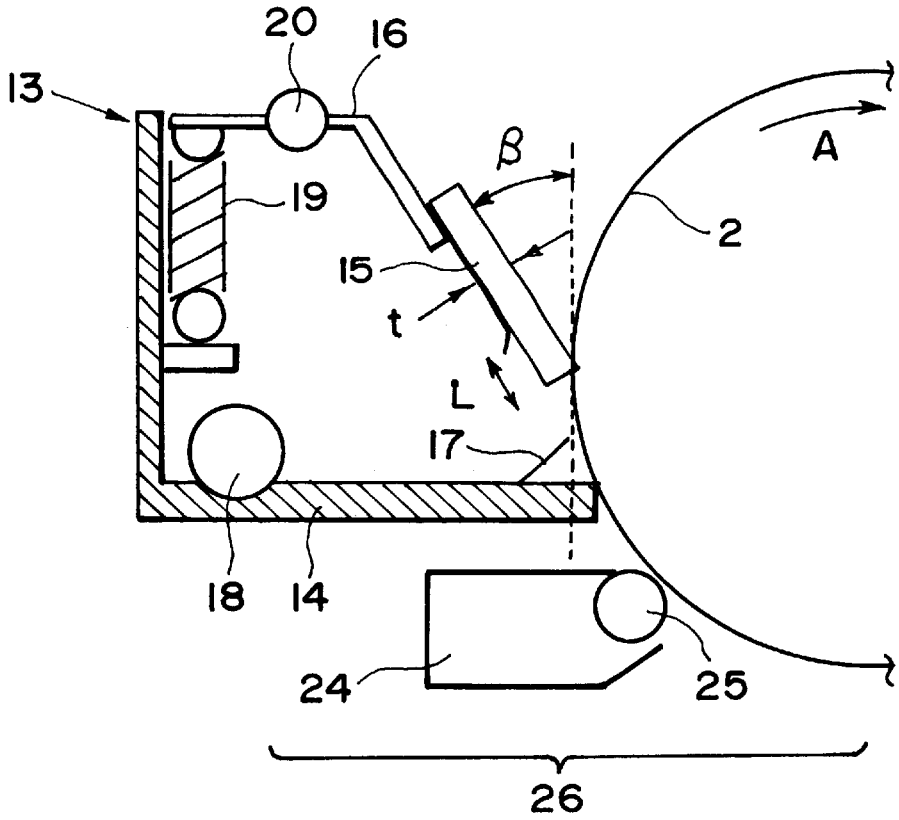
FIG. 7 is a side sectional view of a cleaning device according to the invention used in Example 6.

Example 4 was repeated by using a cleaning device 13 having a structure shown in FIG. 7 instead of the cleaning device of FIG. 4.

Referring to FIG. 7 wherein like parts are denoted by like reference numerals as shown in FIG. 4, the cleaning device 13 has an identical structure as the one shown in FIG. 4 except for including a cleaning aid supply means 26 for an image-bearing member 2 at a position downstream of a transfer means (not shown) and an upstream of a cleaning blade 15 with respect to the rotation direction (A in FIG. 7). The cleaning aid supply means 26 includes a cleaning aid storage 24 and a brush roller 25 for supplying cleaning aid particles 21 to the image-bearing member 2. The cleaning aid supply means 26 may have another structure if it can supply a cleaning aid 21 at a prescribed rate.

In this embodiment different from the embodiment of FIG. 4, an ordinary toner not containing a cleaning aid 21 is supplied from a developing device. Instead, the mixing proportion of cleaning aid 21 in the transfer residual toner 22 is controlled at a desired value by changing the rotation speed of the brush roller 25 of the cleaning aid supply means 26. While confirming the mixing proportion of the cleaning aid 21 in the transfer residual toner as in Example 4, the rotation speed of the brush roller 25 was controlled so as to provide a cleaning aid mixing proportion of 3–60 wt. %.

According to the method of measuring the cleaning aid residential width using a semitransparent glass-based drum used in Example 1, abutting angles β of the cleaning blade 15 for providing various cleaning aid residential widths L1 were similarly measured at various mixing proportions of cleaning aid 21 in transfer residual toner 22. The results are shown in Table 7.

TABLE 7

| Mixing proportion of cleaning aid | Abutting angle β(deg.) for providing various residential width L1 of cleaning aid | | | | |
|---|---|---|---|---|---|
| | Residential width L1 | | | | |
| in transfer residual toner | 25 μm | 50 μm | 75 μm | 100 μm | 125 μm (deg.) |
| 3 wt. % | 30 | 26 | 21 | — | — |
| 5 wt. % | 36 | 33 | 28 | 25 | 20 |
| 50 wt. % | 42 | 39 | 35 | 33 | 30 |
| 60 wt. % | — | 42 | 39 | 36 | 34 |

The results shown in Table 7 are similar in tendency to those shown in Table 5 of Example 4. From this, it may be possible to consider that the stable cleaning aid residential width L1 is almost determined by the mixing proportion of cleaning aid 21 in transfer residual toner 22 and the abutting angle β of the cleaning blade 15. This assumption is supported by the fact that identical cleaning aid residential widths L1 were obtained at identical proportion of cleaning aid 21 in transfer residual toner and abutting angle β of the cleaning blade 15 in two embodiments of different organizations.

Based on the results shown in Table 7, continuous image forming tests were performed on 20,000 sheets in each environment of normal temperature/low humidity (NT/LH=24° C./10% RH), normal temperature/normal humidity (NT/NH=24° C./55% RH), and high temperature/high humidity (HT/HH=30° C. /80% RH) while changing the mixing proportion of cleaning aid 21 in transfer residual toner and cleaning aid residential width L1. The results are inclusively shown in Table 8 below.

TABLE 8

| Cleaning aid in transfer residual toner | Environment | L1 (μm) 25 | 50 | 75 | 100 | 125 |
|---|---|---|---|---|---|---|
| 3 wt. % | NT/LH | CF | CF | CF | — | — |
| | NT/NH | CF | A | A | — | — |
| | HT/HH | A | A | AS | — | — |
| 5 wt. % | NT/LH | CF | A | A | A | A |
| | NT/NH | A | A | A | A | AS |
| | HT/HH | A | A | A | A | AS |
| 50 wt. % | NT/LH | CF | A | A | A | A |
| | NT/NH | A | A | A | A | AS |
| | HT/HH | A | A | A | A | AS |
| 60 wt. % | NT/LH | — | A | A | A | AS |
| | NT/NH | — | A | A | AS | AS |
| | HT/HH | — | AS | AS | TO | TO |

The results of this example were similar to those in Example 4 and exhibited that good cleaning performances for a spherical toner were attained in the case where the mixing proportion of cleaning aid 21 in transfer residual toner 22 was in the range of 5–40 wt. %, and the residual width L was in the range of 50–100 μm.

What is claimed is:

1. A cleaning method for an image-bearing member in an electrophotographic image forming apparatus of the type including an image-bearing member for bearing a toner image thereon, a transfer means for transferring the toner image from the image-bearing member to a recording medium at a transfer position, a drive mechanism for moving the image-bearing member, and a cleaning blade abutted against the image-bearing member for removing a transfer residual toner remaining on the image-bearing member after the transfer of the toner image to the recording medium in accordance with the movement of the image-bearing member, said method comprising the step of:

disposing cleaning aid particles having a volume average particle size of 0.1–3 μm smaller than that of the toner are caused to be resident in a width of 50–100 μm along an upstream side of the cleaning blade with respect to the moving direction of the image-bearing member.

2. A cleaning method according to claim 1, wherein the cleaning aid particles have a volume-average particle size of 0.1–1 μm.

3. A cleaning method according to claim 2, wherein the toner has a volume-average particle size of 4–10 μm.

4. A cleaning method according to claim 2, wherein the toner comprises indefinitely shaped toner particles having a volume-average particle size of 5–10 μm.

5. A cleaning method according to claim 4, wherein the indefinitely shaped toner particles have shape factors SF-1 of 150–200 and SF-2 of 130–150.

6. A cleaning method according to claim 1, wherein the cleaning aid particles comprise inorganic particles having a Mohs hardness of at least 6.0.

7. A cleaning method according to claim 1, wherein the cleaning aid particles are supplied from a cleaning aid supply means disposed at a position downstream of the transfer position and upstream of the cleaning blade with respect to the moving direction of the image-bearing member.

8. A cleaning method according to claim 1, wherein the toner comprises spherical toner particles.

9. A cleaning method according to claim 8, wherein the transfer residual toner contains 5–40 wt. % of the cleaning aid particles.

10. A cleaning method according to claim 8, wherein the spherical toner particles have shape factors SF-1 and SF-2 satisfying $100 \leqq SF\text{-}1 \leqq 140$ and $100 \leqq SF\text{-}2 \leqq 120$.

11. A cleaning method according to claim 8, wherein the toner comprises spherical magnetic toner particles.

12. A cleaning method according to claim 8, wherein the toner is a polymerization toner produced by polymerizing a polymerizable monomer composition dispersed in an aqueous dispersion medium.

13. A cleaning method according to claim 1, wherein the cleaning aid particles have a BET specific surface area of 1–10 $m^2/g$.

14. An electrophotographic image forming apparatus, comprising: an image-bearing member for bearing a toner image thereon, a transfer means for transferring the toner image from the image-bearing member to a recording medium at a transfer position, a drive mechanism for moving the image-bearing member, and a cleaning blade abutted against the image-bearing member for removing a transfer residual toner remaining on the image-bearing member after the transfer of the toner image to the recording medium in accordance with the movement of the image-bearing member, wherein said image forming apparatus further includes a cleaning aid-supply means for supplying cleaning aid particles at a position downstream of the transfer means and upstream of the cleaning blade, respectively with respect to the moving direction of the image-bearing member.

15. An image forming apparatus according to claim 14, wherein the cleaning aid particles have a volume-average particle size of 0.1–3 μm smaller than that of the toner.

16. An image forming apparatus according to claim 14, wherein the cleaning aid particles comprise inorganic particles having a Mohs hardness of at least 6.0.

* * * * *

UNITED STATES PATENT AND TRADEMARK OFFICE

CERTIFICATE OF CORRECTION

PATENT NO. : 6,311,037 B1
DATED : October 30, 2001
INVENTOR(S) : Hisataka Hisakuni et al.

It is certified that error appears in the above-identified patent and that said Letters Patent is hereby corrected as shown below:

Column 3,
Line 57, "This however" should read -- This, however, --.

Column 5,
Line 10, "member, wherein" should read -- member, --;
Line 11, "said" should read -- wherein said --;
Line 12, "aid-supply" should read -- aid supply --; and
Line 58, "Leaning" should read -- cleaning --.

Column 6,
Line 20, "formed" should read -- form --.

Column 8,
Line 45, "a id" should read -- aid --.

Signed and Sealed this

Ninth Day of April, 2002

*Attest:*

*Attesting Officer*

JAMES E. ROGAN
*Director of the United States Patent and Trademark Office*